US010844330B2

(12) United States Patent
Amato et al.

(10) Patent No.: US 10,844,330 B2
(45) Date of Patent: Nov. 24, 2020

(54) SYSTEM AND A PROCESS OF A FABRIC MATERIAL

(71) Applicants: Joe Amato, Galesville, MD (US); Les Bridwell, Suwannee, GA (US); Howard Nemovitz, St. Pete Beach, FL (US)

(72) Inventors: Joe Amato, Galesville, MD (US); Les Bridwell, Suwannee, GA (US); Howard Nemovitz, St. Pete Beach, FL (US)

( * ) Notice: Subject to any disclaimer, the term of this patent is extended or adjusted under 35 U.S.C. 154(b) by 345 days.

(21) Appl. No.: 15/431,651

(22) Filed: Feb. 13, 2017

(65) Prior Publication Data

US 2017/0233686 A1 Aug. 17, 2017

Related U.S. Application Data

(60) Provisional application No. 62/295,133, filed on Feb. 14, 2016.

(51) Int. Cl.

| | |
|---|---|
| ***C11D 1/00*** | (2006.01) |
| ***C11D 1/62*** | (2006.01) |
| ***D06F 39/08*** | (2006.01) |
| ***C11D 3/48*** | (2006.01) |
| ***C11D 3/16*** | (2006.01) |
| ***C11D 11/00*** | (2006.01) |
| ***D06F 39/02*** | (2006.01) |

(52) U.S. Cl.

CPC ..... *C11D 3/48* (2013.01); *C11D 3/162* (2013.01); *C11D 11/0017* (2013.01); *D06F 39/022* (2013.01); *D06F 39/088* (2013.01)

(58) Field of Classification Search

CPC .. C11D 1/00; C11D 1/62; C11D 3/162; D06F 39/08

See application file for complete search history.

(56) References Cited

U.S. PATENT DOCUMENTS 5,145,596 A * 9/1992 Blank ..... C11D 3/162 510/466

6,158,486 A * 12/2000 Olson ..... B65D 23/10 141/351

* cited by examiner

*Primary Examiner* — Brian P Mruk

(74) *Attorney, Agent, or Firm* — Steptoc & Johnson LLP

(57) ABSTRACT

A water-soluble antimicrobial liquid delivery, quality control tracking and monitoring system and method can be directly integrated into commercial laundry equipment and operational systems.

7 Claims, 2 Drawing Sheets

SYSTEM AND A PROCESS OF A FABRIC MATERIAL

This application claims priority under 35 U.S.C. § 119(e) to U.S. Patent Application Ser. No. 62/295,133 filed on Feb. 14, 2016, which is hereby incorporated by reference in its entirety.

TECHNICAL FIELD

This invention relates to treatment of a fabric material.

BACKGROUND

Hospitals, clinics, and urgent care centers can benefit from maximized microbial protection. For example, hospital sheets, towels, pillow cases, scrubs and lab coats require antimicrobial protection in a large quantity. The existing antimicrobial technology, which is typically applied at the factory to finished goods, is geared for the specialty market. The single stage treatment of antimicrobial infused process has not been viable as mass production because it can be too costly and can only be applied on certain fabrics, only once in set factory locations, and only under factory determined conditions.

SUMMARY

A fabric material treatment system comprising can include a chamber for washing a fabric material having a washing zone and a treatment zone downstream from the washing zone, a reservoir for a surface-active agent, wherein the reservoir feeds the surface-active agent to the chamber, and an injection pump attached to the reservoir and the treatment zone to inject the surface-active agent from the reservoir into the treatment zone.

In certain embodiments, the chamber can be a laundry wash tunnel. The system can further include a computerized docking station. In certain embodiments, the injection pump can be operated by the computerized docking station.

The system can further include a treatment monitoring kit. In certain embodiments, the system can include a real-time treatment monitoring kit.

In certain embodiments, the surface-active agent can be an antimicrobial agent. In certain embodiments, the antimicrobial agent can include a quaternary ammonium silane. In certain embodiments, the antimicrobial agent can include a 3-(trimethoxysilyl) propyldimethyloctadecyl ammonium chloride.

In certain embodiments, the surface-active agent can be an anti-odor agent.

A process of treating a fabric material can include injecting a surface-active agent from a reservoir to a treatment zone in a laundry wash tunnel, and fixing the agent on the fabric material by operating the laundry wash tunnel.

In certain embodiments, the injecting the surface-active agent to the laundry wash tunnel can be controlled by a computerized docking station.

In certain embodiments, fixing the surface-active agent on the fabric material can include forming covalent bonds between the surface-active agent and a surface of the fabric material.

In certain embodiments, the surface-active agent can be an antimicrobial agent. In certain embodiments, the antimicrobial agent can include a quaternary ammonium silane. In certain embodiments, the antimicrobial agent can include a 3-(trimethoxysilyl) propyldimethyloctadecyl ammonium chloride.

In certain embodiments, the surface-active agent can be an anti-odor agent.

In certain embodiments, the process can further include washing the fabric material in a washing zone before injecting an surface-active agent to the treatment zone.

In certain embodiments, the process can further include removing the surface-active agent on the fabric material in the washing zone.

In certain embodiments, the process can further include monitoring a level of treatment real-time.

Other aspects, embodiments, and features will be apparent from the following description, the drawings, and the claims.

DETAILED DESCRIPTION

Figure 1:
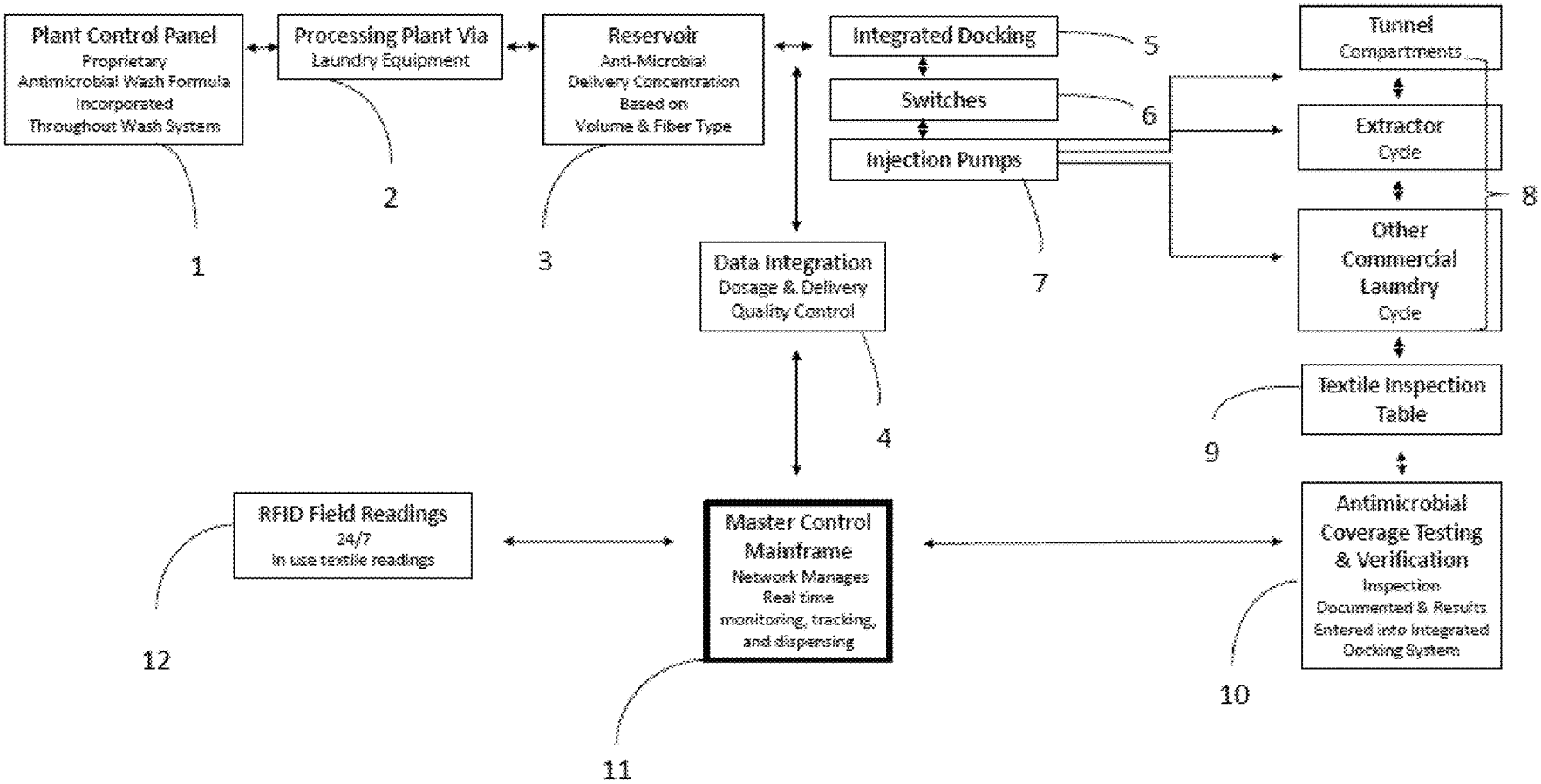
FIG. 1 shows an example of the system for surface-active agent treatment.

Various antimicrobial technologies have been tried for fabrics, but only as a single or one-time application of antimicrobial treatment during the production of the fiber itself, post production of the fiber, or after construction of finished goods. Also, the application has been limited only to compatible fiber types and required specifically designed tanks in a specific manufacturing facility.

The traditional methods for antimicrobial fabric treatment require the fabric materials to be prepared and scoured such that there would be no impurities that might interfere with the adherence of the antimicrobial agent. In addition, the fabric should be free of water and fully dried to have a good affinity for the antimicrobial agent. Thus, the traditional systems typically uses dry-to-dry or dry-to-wet finishing. The traditional methods also require high water temperature, which makes the process expensive and impractical. Further more, the traditional methods would need to capture all antimicrobial agents during processing because of the high cost of materials used and to prevent heavy metals or other environmentally harmful agents from being released into the effluent. It would never be practical to use a spray system to apply antimicrobial agents in a commercial laundry operation because it would entail building a complex additional system, such as roll goods utilizing a conveyer line that ultimately encounters multiple, topical spray nozzles sprayed continuously to cover fabric, which then runs through a curing station, and ultimately being roll-cut to the appropriate roll-size for shipment out to various types of customers. There can be no continuous roll goods to spray and cover various shapes and sizes of fabric materials at one time to make it practical.

Disclosed herein is practical and economical way to deliver a surface-active agent to new or old fabric and on any fabric type, utilizing current commercial laundry machines and wash formulas without disruption. The surface active agent can be an antimicrobial agent or an anti-odor agent. The surface-active agent can react with water and is best dispensed from a closed vessel system. The washing machine can act as a closed chamber bath and make the ideal housing for hydrolysis of the surface-active agent to occur which only affixes to the fabric itself. Therefore, this method utilizes wet-to-wet finishing, as opposed to dry-to-dry or dry-to-wet finishing in the traditional methods.

A controlled system for the treatment of fabrics is designed to improve linen, fabric and garment quality through the control of bacteria and odor growth, reduce fiber degradation and reduce the use of harmful cleaning agents.

In one aspect, a commercial laundry washing machine can act as a closed chamber bath and processing plant, utilizing standard operation condition without disruption and effectively affix a water-soluble antimicrobial agent to a fabric material.

In another aspect, a laundry wash tunnel can be any commercial wash tunnels, extractors and any other laundry equipment. The laundry wash tunnel can be compartmentalized for various chemical baths for different timing. The laundry wash tunnel acts as a closed chamber providing an appropriate environment for chemisorption or bonding of a surface-active agent to the fabric material to occur.

In another aspect, antimicrobial solutions can be continuously fed through a holding tank by an integrated docking station that in turn feeds directly into the wash load. The entire system can be on-site and remotely monitored and tracked. Determining equipment viability and compatibility, precise control of feeding time, quantity, temperature, water flow rates, measurement of water-soluble antimicrobial, pH levels, and exhaustion times for determined pickup of antimicrobial fabric adherence are critical for the optimum performance of the system.

The method allows an initial application and future reapplications of antimicrobial solutions to any type of fabrics, and importantly in any processing wash facility to ensure the highest levels of control/efficacy are processed during a wash load. This method allows delivery of a permanent level of linen hygiene that is maintained to control excess soiling, microbial growth and odor between washings and extends the fabric life.

This method enables the delivery of a desired surface-active agent to a fabric at any time, and anywhere using commercial laundry formula geared to the commercial laundry industry that allows multiple applications of antimicrobial fabric treatment on site (during laundry washing) to any old or new linen, textile or apparel products of any fiber type and at any stage of fabric life.

This method enables a hygienically clean treatment without the use of excess bleach or complex facilities and extends linen life as well. This method can deliver a continuous antimicrobial treatment that allows microbial protection to be reapplied whenever deemed necessary to ensure the highest level of hygiene to meet any market demand.

In this method, a commercial laundry/wash machine (tunnel or front loader) can act as a water tight, sealed chamber to allow exhaustion of an antimicrobial agent during regular scheduled washings. This method uses water for hydrolysis for the antimicrobial agent to readily adhere to fabrics. Also a specifically designed injection-pump can be used to introduce the surface-active agent to the laundry machine and controlled by a computerized docking station. The pipe diameter can be adjusted for delivery compatibility. A designated amount of the surface-active agent can be delivered at a designated time. The wash formula can be integrated to be programmed for a laundry plant operating system for total chemical compatibility. Any compatible water-soluble formulation of surface-active agent can be combined with a determined exhaustion time that allows an economical and real-time application. This method can ensure up to 99.99% reduction in bacterial growth between washings in most any laundry facility without disruption to existing operations.

A fabric material treatment system for antimicrobial processing plants or commercial laundry facilities can include a precise control of formulation, housed on-site, which holds an water-soluble surface-active agent in a dedicated storage container, docked and system integrated on-site, remotely monitored and tracked, and continuously deliver a predetermined rate of feed.

FIG. 1 shows a schematic of the fabric material treatment system. The system can be controlled by a plant control panel 1 that includes an antimicrobial wash formula incorporated throughout wash system. The system can include a processing plant via laundry equipment 2. The laundry equipment can include a washing zone and a treatment zone. The laundry equipment can be connected a reservoir 3. In certain embodiments, the treatment zone of the laundry equipment can be connected to a reservoir 3. In the reservoir 3, a surface-active agent (e.g. antimicrobial agent) can have s a concentration based on the volume and the fiber type of the fabric material. A data integration system 4 can determine dosage and delivery and monitor quality control via a reservoir 3 and an integrated docking system 5. The integrated docking system 5 can operate an injection pump 7 through switches 6. The reservoir 3 feeds the surface-active agent to the laundry equipment. The injection pump 7 can be connected to tunnel compartments and extractor and other commercial laundry cycles 8. The system can also include a textile inspection table 9. An antimicrobial coverage test and verification system 10 can be connected to the textile inspection table 9 for documentation of inspection results which are entered into the integrated docking system 5. The system can further include a master control mainframe 11, where the network manages real-time monitoring, racking and dispensing. In certain embodiments, the system can further include 24/7 radio-frequency identification (RFID) field readings 12 for various textile information.

A reservoir can contain a water-soluble surface-active agent continuously being feed into any commercial washing machine (FIG. 1). The surface-active agent can be an antimicrobial agent or an anti-odor agent. In certain embodiments, the washing machine can act as a closed chamber bath and make the ideal housing for hydrolysis of the surface-active agent to occur which only affixes to the fabric itself.

A wash recipe determines water flow rate, timing and usage for each compartment, dose rates, optimal pH range, chemical & equipment compatibility, optimal chemical environment, optimal temperature control, fabric weight to water weight ratios, necessary exhaustion times, and reapplication rates. Detergents or boosters can be utilized to ensure compatibility and efficient bonding of the surface-active agent to the fabric material.

The wash recipe should be compatible with a fabric type to maximize the chemical bonding to the fabric and prevent the fabric damage. The wash recipe can change depending on the fiber composition. The wash recipe can be either for the permanent bonding of the surface-active agent to the fabric or for the temporary bonding of the surface-active agent only between washings, or for extended periods, e.g. 40 washes or more, based on adjustable washing recipe inputs and customer requirements and expectations.

The system can include a docking station, a metering, measuring and dosing device, an automatic feed system capable of system integration and remote monitoring to ensure correct exhaustion and warranty levels are achieved.

The system can be capable of real time tracking of the antimicrobial dosage for proof of delivery/coverage and strength level. The surface-active agent can be timely dosed via an electronically controlled and fully integrated pump system for automated process.

A radio-frequency identification (RFID) system can be incorporated into the system to provide data on microbial growth rate, sanitation level, fiber weight/loss, visual fiber damage, aesthetic, brightness, and soiling.

A desiccant cartridge can be added to minimize moisture intake on the container once in use, acting as a safety valve between applications or during down time. It could be added to the chamber or valves on the line, which can be automated or remain static to be changed when necessary.

Coverage of expected antimicrobial coverage can be tested onsite or remotely after wash load is complete. Post wash testing can be administered by using a bromophenol blue solution to indicate if adequate coverage has taken place. The information is fed into the system to be tracked. Onsite or remote lab testing can include the antimicrobial test and the germicidal sanitizer test.

Antimicrobial Treatment

Antimicrobial protection can reduce the use of chlorine or other environmentally harmful chemical agents. Also, non-toxic chemistry of an antimicrobial agent, unlike bleach, reduces risk and downstream problems with equipment.

An antimicrobial finish protection technology can incorporate a water soluble surface-active solution and can be applied via industrial laundry facilities servicing the health-care industry. Applied in a single stage of wet finish process can offer a superior affinity to fabric. A unique coating process allows the fabric to go through a chemisorption process when comingled with the industrial wash load. The antimicrobial agent can be formulated in a non-flammable solvent and include no heavy metals for easy dispensability. It can effectively inhibit the growth of mold and mildew, algae and bacteria on various surfaces. It can protect against microbial deterioration, discoloration and odor development. It can safely break down harmful Gram-positive and Gram-negative bacteria and other harmful microbes.

The antimicrobial agent can include a quaternary ammonium silane. The quaternary ammonium silane can be based on a coconut oil derivative which is a renewable source.

The quaternary ammonium silane based technology is non-fugitive, unlike products such as triclosan, which is fugitive. Fugitive products create "zones of inhibition." On the edges of the zones, the fugitive antimicrobial is much weaker than in the inner part of the zones. In these "weak areas" of the zone, the bacteria are not readily destroyed, creating the possibility of the bacterial mutation and resistance to the antimicrobial. Triclosan is also a chlorinated solvent. The quaternary ammonium silane compound can penetrate the cell wall of the bacteria and destroys the micro-organisms.

Traditional sanitizing agent uses leaching technology and dermal transfer can occur upon contact with traditional sanitizers. The quaternary ammonium silane compound technology is based on molecular bonding and therefore does not transfer to patients upon contact.

Another form of commonly used antimicrobial is derivatives of heavy metals, which can cause many problems with the environment. The most commonly used is the zinc almodine. Unlike the quaternary ammonium silane, the zinc product does not have an affinity for the fiber, thus cannot be applied from a long-bath such as washers.

In certain embodiments, an ion exchange occurs when the cation of a quaternary ammonium silane compound replaces protons from the water on the surface, enabling a homopolymerize effect on the fabric itself and producing a non-leaching technology that delivers permanent protection between washings.

Figure 2:
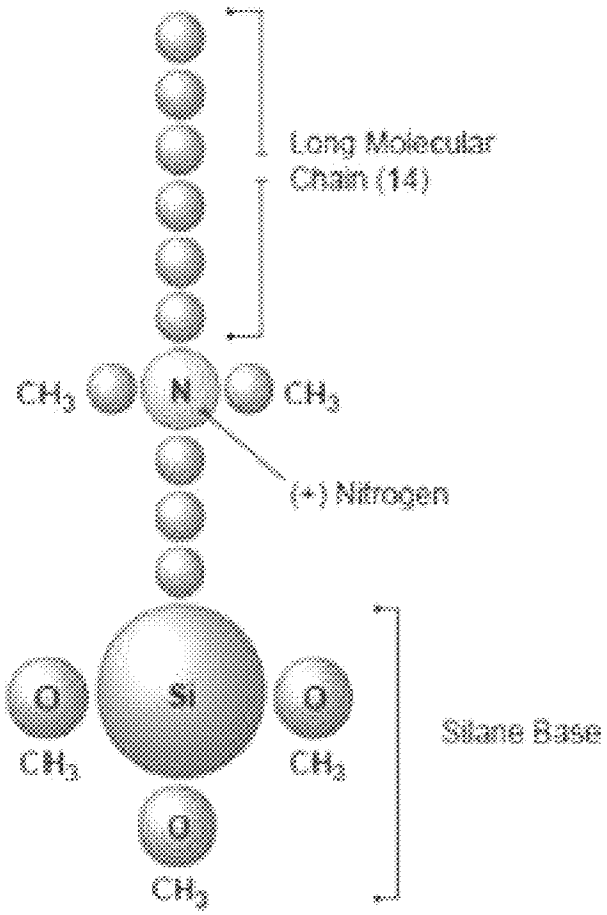
FIG. 2 shows the chemical structure for a quaternary ammonium silane.

In the quaternary ammonium silane, the base part of the molecule is the silane base (FIG. 2). The silane base is the antimicrobial anchor. The antimicrobial is anchored by covalent bonds which are formed gradually through hydrolysis reactions that bond the antimicrobial permanently to almost any surface via crosslinking and polymerization with other molecules.

The middle part of the molecule is centrally located positively charged nitrogen (FIG. 2). It plays an important role in the active nature of the antimicrobial. Certain cell walls of microbes are negatively charged, and when in close proximity, these microbes are drawn into the active surface of the antimicrobial compound and pulled down towards the center point. The negative and positive charges also naturally create an electrostatic blow to the offending microbes.

The top of the chain creates an edge of defense to penetrate into the microbes. The long molecule chain can act like a spike that punctures the cell membranes of any microbe coming in contact with it (FIG. 2).

A quaternary ammonium silane can be a 3-(trimethoxysilyl) propyldimethyloctadecyl ammonium chloride. It imparts a durable antimicrobial finish to the surfaces of a wide variety of substrates. It is leach resistant and non-migrating technology (i.e. not transferring upon dermal contact) and not consumed by microorganisms.

EXAMPLES

For all examples below, the following formulas were used:

Formula for Log Reduction

Determine Log ($x*10^a$) of Control Samples

Determine Log ($x*10^a$) of Treated Samples

Determine Geometric Mean of Control Samples

Log values of control samples: $b_1, b_2, b_3, \ldots b_n$ $$\text{Mean}=(b_1*b_2*b_3* \ldots b_n)^{1/n}$$

Determine Geometric Mean of Treated Samples

Log values of treated samples: $c_1, c_2, c_3, \ldots c_n$ $$\text{Mean}=(c_1*c_2*c_3* \ldots c_n)^{1/n}$$

Log reduction=geometric mean of the control samples−geometric mean of the treated samples Where:
x=value of samples
a=exponent value
b=log value of control samples
c=log value of treated samples
n=number of log values in set

Formula for Percent Reduction $$(1-10^{-\log \text{reduction}})\times 100$$

Example 1. Linen Fabric Treated with a Quaternary Ammonium Silane

Introduction

A white linen fabric was tested for assessment of antibacterial activity.

1) Tunnel Treated 1.3%
2) 1.3% Washer 10 min
3) 1.0% washer . . . 10 min

Materials and Methods

The system was used to quantitatively assess the antibacterial activity of this fabric sample. The Gram-negative bacteria challenge was *E. coli* ATCC 25922. The specified contact time was 24 hours.

Discussion

Under these test conditions, sample 2 & 3 showed better inhibitory properties than sample 1. Sample 2 & 3 reduced the challenge *E. coli* bacteria by over 2 logs.

Example 2. Linen Fabric Treated with a Quaternary Ammonium Silane

Introduction

A white linen fabric was tested for assessment of antibacterial activity.

1) Tunnel Treated 1.3%
2) 1.3% Washer 10 min
3) 1.0% washer . . . 10 min

Materials and Methods

The system was used to quantitatively assess the antibacterial activity of this fabric sample. The Gram-negative bacteria challenge was *Staphylococcus aureus* ATCC 6538. The specified contact time was 24 hours.

| Results: Sample | Avg. 0 hr Control CFU | Avg. 24 hr Treated CFU | Log Reduction | Percent Reduction |
|---|---|---|---|---|
| 1) Tunnel Treated 1.3% | $1.1 \times 10^5$ | $5.69 \times 10^3$ | 1.25 | 94.34 |
| 2) 1.3% Washer 10 min | $1.0 \times 10^5$ | $1.8 \times 10^2$ | 1.75 | 98.22 |
| 3) 1.0% washer 10 min | $1.0 \times 10^5$ | $9.17 \times 10^3$ | 2.04 | 99.08 |

Discussion

Under these test conditions, sample 3 showed better inhibitory properties than sample 1

| Results: Sample | Avg. 0 hr Control CFU | Avg. 24 hr Treated CFU | Log Reduction | Percent Reduction |
|---|---|---|---|---|
| 1) Tunnel Treated 1.3% | $1.1 \times 10^5$ | $8.08 \times 10^3$ | 1.24 | 94.22 |
| 2) 1.3% Washer 10 min | $1.1 \times 10^5$ | $4.90 \times 10^2$ | 2.46 | 99.65 |
| 3) 1.0% washer 10 min | $5 \times 10^5$ | $3.67 \times 10^3$ | 2.24 | 99.42 |

or 2. Sample 3 reduced the challenge *S. aureus* bacteria by over 2 logs.

Example 3. White Linen Fabric Treated with a Quaternary Ammonium Silane

Introduction

A white linen fabric was tested for assessment of antibacterial activity.

1) Tunnel Treated 1.3%
2) 1.3% Washer 10 min
3) 1.0% washer . . . 10 min

Materials and Methods

The system was used to quantitatively assess the antibacterial activity of this fabric sample. The challenge bacteria specified was *Staphylococcus aureus* (MRSA) ATCC 43300. The specified contact time was 24 hours.

| Results: Sample | Avg. 0 hr Control CFU | Avg. 24 hr Treated CFU | Log Reduction | Percent Reduction |
|---|---|---|---|---|
| 1) Tunnel Treated 1.3% | $1.4 \times 10^5$ | $6.20 \times 10^4$ | 0.35 | 55.74 |
| 2) 1.3% Washer 10 min | $1.4 \times 10^5$ | $1.0 \times 10^3$ | 2.15 | 98.22 |
| 3) 1.0% washer 10 min | $1.4 \times 10^5$ | $7.75 \times 10^2$ | 2.26 | 99.45 |

Discussion

Under these test conditions, samples 2 & 3 showed the best inhibitory properties against this MRSA strain. Sample 1 did not significantly reduce this bacteria.

Example 4. Pillow Case Samples with a Quaternary Ammonium Silane

Introduction

Pillowcase fabric sample was submitted for antibacterial activity against *E. coli.*, *Staphylococcus aureus* and *Staphylococcus aureus* (MRSA).

Materials and Methods

The system was used to quantitatively assess the antibacterial activity of these samples. Three challenge bacteria were specified; *E. coli* ATCC 25922, *Staphylococcus aureus* ATCC 6538 and *Staphylococcus aureus* (MRSA) ATCC 43300. The specified contact time was 24 hours.

| Results: bacteria strain | Avg. 0 hr Control CFU | Avg. 24 hr Treated CFU | Log Reduction | Percent Reduction |
|---|---|---|---|---|
| *E. coli* ATCC 25922 | $8.0 \times 10^5$ | $<1.0 \times 10^2$ | 3.93 | 99.98 |
| *Staphylococcus aureus* ATCC 6538 | $6.0 \times 10^5$ | $<1.0 \times 10^2$ | 3.82 | 99.98 |
| *Staphylococcus aureus* (MRSA) ATCC 43300 | $3.0 \times 10^5$ | $1.73 \times 10^2$ | 3.25 | 99.94 |

Discussion

The pillowcase fabric demonstrated multiple log reduction of all three challenge bacteria under these test conditions.

Example 5. Fabric Samples Treated with a Quaternary Ammonium Silane

Introduction

Fabric samples labeled as follows were submitted for antibacterial activity against *Staphylococcus aureus* ATCC 43300 MRSA.

1) Terrycloth fabric
2) Linen fabric labeled #4
3) Linen fabric labeled #3

Materials and Methods

The system was used to quantitatively assess the antibacterial activity of these samples. The challenge bacteria specified was *Staphylococcus aureus* ATCC 43300 MRSA. The specified contact time was 24 hours.

| Results: Sample | Avg. 0 hr Control CFU | Avg. 24 hr Treated CFU | Log Reduction | Percent Reduction |
|---|---|---|---|---|
| 1) Terrycloth fabric | $2.4 \times 10^5$ | $<1 \times 10^2$ | 3.05 | 99.91 |
| 2) Linen fabric labeled #4 | $2.4 \times 10^5$ | $<1 \times 10^2$ | 3.05 | 99.91 |
| 3) Linen fabric labeled #3 | $2.4 \times 10^5$ | $<1 \times 10^2$ | 3.05 | 99.91 |

Discussion

All three samples demonstrated multiple log reduction of the *Staphylococcus aureus* ATCC 43300 MRSA challenge under these test conditions.

Example 6. Fabric Samples Treated with a Quaternary Ammonium Silane

Introduction

Fabric samples labeled as follows were submitted for antibacterial activity against *Staphylococcus aureus* ATCC 6538.

1) Terrycloth fabric
2) Linen fabric labeled #4
3) Linen fabric labeled #3

Materials and Methods

ASTM 2149-12 was used to quantitatively assess the antibacterial activity of these samples. The challenge bacteria specified was *Staphylococcus aureus* ATCC 6538. The specified contact time was 24 hours.

| Results: Sample | Avg. 0 hr Control CFU | Avg. 24 hr Treated CFU | Log Reduction | Percent Reduction |
|---|---|---|---|---|
| 1) Terrycloth fabric | $1.0 \times 10^5$ | $<1 \times 10^2$ | 3.05 | 99.91 |
| 2) Linen fabric labeled #4 | $1.0 \times 10^5$ | $<1 \times 10^2$ | 3.05 | 99.91 |
| 3) Linen fabric labeled #3 | $1.0 \times 10^5$ | $<1 \times 10^2$ | 3.05 | 99.91 |

Discussion

All three samples demonstrated multiple log reduction of the *Staphylococcus aureus* ATCC 6538 challenge under these test conditions.

Other embodiments are within the scope of the following claims.

What is claimed is:

1. A process of treating a fabric material comprising:

washing the fabric material in a washing zone of a laundry wash tunnel followed by injecting a surface-active agent from a reservoir to a treatment zone of the laundry wash tunnel via injection pumps controlled by an integrated docking system;

fixing the agent on the fabric material by operating the laundry wash tunnel; and monitoring a level of treatment in the laundry wash tunnel in real-time with an antimicrobial coverage test and verification system for documentation of inspection results which are entered into the integrated docking system to control the injecting the surface-active agent via injection pumps controlled by the integrated docking system.

2. The process of claim 1, wherein fixing the surface-active agent on the fabric material includes forming covalent bonds between the surface-active agent and a surface of the fabric material.

3. The process of claim 1, wherein the surface- active agent is an antimicrobial agent.

4. The process of claim 3, wherein the antimicrobial agent includes a quaternary ammonium silane.

5. The process of claim 3, wherein the antimicrobial agent includes a 3-(trimethoxysilyl) propyldimethyloctadecyl ammonium chloride.

6. The process of claim 1, wherein the surface-active agent is an anti-odor agent.

7. The process of claim 1, further comprising removing the surface-active agent on the fabric material in the washing zone.

* * * * *